US006812906B2

(12) United States Patent
Goldstein et al.

(10) Patent No.: US 6,812,906 B2
(45) Date of Patent: Nov. 2, 2004

(54) BROADBAND QUARDIFILAR HELIX WITH HIGH PEAK GAIN ON THE HORIZON

(75) Inventors: Mark Lawrence Goldstein, Palm Bay, FL (US); Richard John Nink, Melbourne, FL (US); William Dean Killen, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 21 days.

(21) Appl. No.: 10/138,855

(22) Filed: May 3, 2002

(65) Prior Publication Data

US 2003/0206143 A1 Nov. 6, 2003

(51) Int. Cl.[7] ..... H01Q 1/36
(52) U.S. Cl. ..... 343/895
(58) Field of Search ..... 343/895

(56) References Cited

U.S. PATENT DOCUMENTS 5,170,176 A * 12/1992 Yasunaga et al. ..... 343/895
5,191,352 A * 3/1993 Branson ..... 343/895
5,198,831 A * 3/1993 Burrell et al. ..... 343/895
5,241,323 A 8/1993 Kelly
5,587,719 A 12/1996 Steffy
5,986,619 A * 11/1999 Grybos et al. ..... 343/895
6,011,524 A * 1/2000 Jervis ..... 343/895
6,094,178 A * 7/2000 Sanford ..... 343/895
6,285,341 B1 9/2001 Roscoe et al.
6,288,686 B1 9/2001 Josypenko

* cited by examiner

*Primary Examiner*—Tho Phan
(74) *Attorney, Agent, or Firm*—Sacco & Associates PA

(57) ABSTRACT

The invention concerns a quadrifilar helix antenna that has four orthogonal conductive elements helically wound around a common axis. Each of the conductive elements can have between 3 to 7 turns about the common axis at a pitch of between 45 to 65 degrees. Further, each turn has a diameter of about 0.13 wavelengths to 0.27 wavelengths. A feed coupler excites each of the orthogonal conductive elements in phase quadrature at a feed point located at a first end of the antenna adjacent to a ground plane. The resulting antenna can have an axial length of about 2.3 wavelengths to 6.9 wavelengths. Unlike conventional quadrifillar helix antennas, an opposing end of each of the conductive elements distal from the feed point forms an open circuit. The antenna configured as described can have a peak gain on horizon when the common axis is oriented vertically.

32 Claims, 2 Drawing Sheets

BROADBAND QUARDIFILAR HELIX WITH HIGH PEAK GAIN ON THE HORIZON

STATEMENT REGARDING FEDERALLY SPONSORED RESEARCH OR DEVELOPMENT

The United States Government has rights in this invention pursuant to Contract No. F33657-98-G-3605 between the United States Air Force Aeronautical Systems Center. Reconnaissance Systems Program Office, Contracting Branch; Wright Patterson Air Force Base and Harris Corporation.

BACKGROUND

1. Technical Field

The invention concerns antennas and more particularly, quadrifilar helix antennas having peak gain on the horizon for all azimuth look angles.

2. Description of the Related Art

Circular polarization is often employed in systems for communicating with earth orbiting satellites and long-range airborne vehicles. Circularly polarized systems are advantageous in these applications because they are resistant to multipath effects, and resist the effects of fading caused by mismatched polarizations due to aircraft pitch and roll. Quadrifilar helix antennas (QHAs) are known in the art to be well suited for these types of communications systems because they are circularly polarized and can provide positive gain for any visible satellite location.

The basic design of a QHA is well known. The antenna consists of two bifilar helical loops, each consisting of two legs. These loops are oriented in a mutual orthogonal relationship on a common axis. Each of the four legs of this antenna is fed a signal 90 degrees apart in phase (i.e., in phase quadrature). One of the commonly accepted advantages of such antennas is that they generally do not require a conventional ground plane.

It is generally known that the number of turns and the length to diameter ratio can affect the radiation pattern of a quadrifilar helix antenna. For example, it has been found that tall narrow designs can show some gain to the horizon and decreased gain on-axis. U.S. Pat. No. 5,587,719 to Steffy discloses that quadrifilar helices of two to five turns are used in low-altitude spacecraft designs for this reason.

Still, an optimal design for a quadrifilar antenna for airborne line of sight data links has proved elusive. Such systems ideally should have maximum gain at the horizon for far range communications. The gain on horizon should be as large as possible to overcome path losses in that direction. Moreover, the change in communication path loss from very near the horizon (~1.8° elevation) to nadir (90° elevation) allows such systems to have approximately 30 dB less gain at nadir for close-in communications. Consequently, there is a need for a simple, low cost antenna with circular polarization, maximum gain on horizon, 360-degree azimuth pattern, 90-degree elevation pattern, and up to 7% radiation bandwidth (3 dB) is needed. Despite the highly desirable nature of such a pattern, an optimal design with peak gain on the horizon has proven difficult to achieve due to the number of design variables and their interdependent effect upon performance.

SUMMARY OF THE INVENTION

The invention concerns a quadrifilar helix antenna that has four orthogonal conductive elements helically wound around a common axis. Each of the conductive elements can have between 3 to 7 turns about the common axis at a pitch of between 45 to 65 degrees. Further, each turn has a diameter of approximately 0.13 wavelengths to 0.27 wavelengths. A feed coupler excites each of the orthogonal conductive elements in phase quadrature at a feed point located at a first end of the antenna adjacent to a ground plane. The resulting antenna can have an axial length of approximately 2.3 wavelengths to 6.9 wavelengths. Unlike conventional quadrifilar helix antennas, an opposing end of each of the conductive elements distal from the feed point forms an open circuit. The antenna configured as described can have a peak gain on horizon when the common axis is oriented vertically.

According to one aspect of the invention, each conductive element of the antenna can be formed with approximately five turns at a pitch of approximately 55 degrees, with a turn diameter of approximately 0.18 wavelengths to 0.2 wavelengths, and an axial length of about 4.2 to 4.5 wavelengths. Configured in this way, the antenna can provide a peak gain on the horizon of about 6.5 dBic when the common axis of the antenna is oriented vertically. The antenna will also have a 3 dB bandwidth of between 5% to 8% of a center operating frequency.

DETAILED DESCRIPTION OF THE PREFERRED EMBODIMENTS

Figure 1:
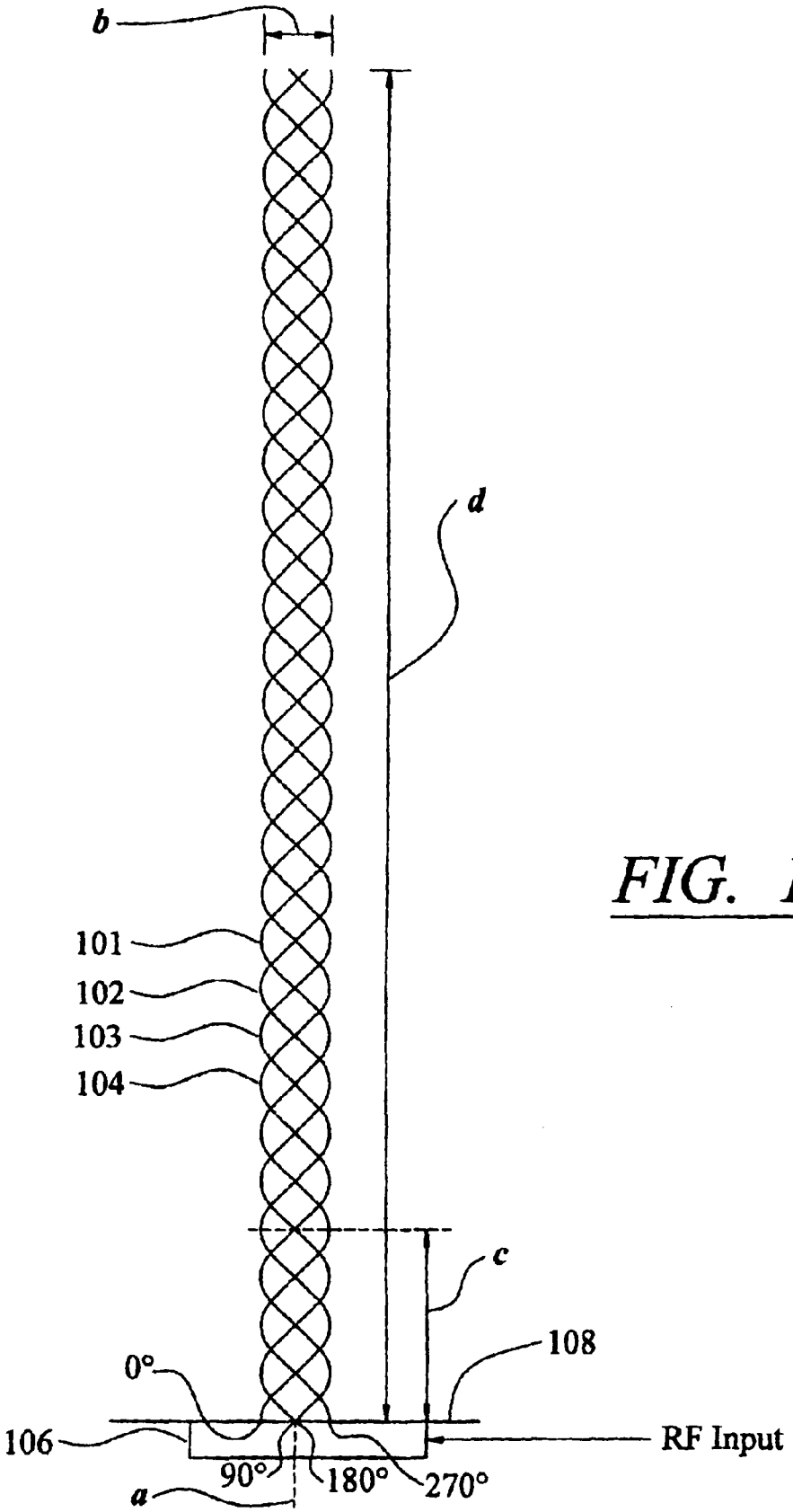
FIG. 1 is a drawing useful for showing the geometry of a quadrifilar helix antenna optimized for satellite and aircraft communications.

FIG. 1 is a drawing useful for showing the geometry of a quadrifilar helix antenna optimized for satellite and aircraft communications. The antenna is generally comprised of four orthogonal conductive elements 101, 102, 103, and 104 helically wound around a common axis "a". Each of the antenna elements is preferably positioned over a ground plane 108 as shown in FIG. 1. A feed coupler 106 is preferably provided for exciting each of the orthogonal conductive elements 101, 102, 103, 104 in phase quadrature, i.e. 0°, 90°, 180°, and 270°. In one embodiment, the individual elements can be fed using insulated feeds passing through openings formed in the ground plane as shown. However, the invention is not limited in this regard and other feed arrangements that provide phase quadrature are possible. Unlike conventional quadrifilar helix antennas that conductively join opposing ends of the orthogonal conductive elements at a distal end opposed from the feed point, the individual antenna elements 101, 102, 103, 104 in the present invention preferably form an open circuit (no connection) at a distal end opposed from the feed point.

Substantial amounts of peak gain directly on the horizon can be achieved using the antenna of FIG. 1 with properly configured elements. According to one embodiment of the invention, each of the four orthogonal conductive elements 101, 102, 103 and 104 can be comprised of between 3 and 7 turns. For example, in FIG. 1, an antenna with five turns is shown. A complete rotation or turn of each element 101, 102, 103, 104 relative to a starting point at ground plane 108 is illustrated by reference "c". A diameter "b" of each turn can be about 0.13 wavelengths to 0.27 wavelengths. Further, each turn can be helically wound around the common axis "a" at a pitch of between 45 to 65 degrees so that the antenna will generally have an axial length "d" of about 2.3 wavelengths to 6.9 wavelengths. The precise diameter of each of the individual conductors is not critical, although larger diameter conductors will generally provide slightly larger bandwidths. It will be appreciated that within the range of values specified herein, the specific number of turns, the turn diameter and the pitch can be adjusted as necessary to optimize the antenna gain, bandwidth and center frequency for use in a particular application.

In a preferred embodiment, an optimized configuration of the antenna for airborne vehicles can have 5 turns, each having a diameter of approximately 0.18 wavelengths to 0.2 wavelengths helically wound around the common axis "a" at a pitch of 55 degrees. In that case, the antenna will have an overall axial length of approximately 4.2 wavelengths to 4.5 wavelengths. The exact results achieved using the foregoing specifications can vary somewhat with frequency. However, computer simulations have shown that this optimized configuration provides substantial amounts of peak gain directly on the horizon over a 5% to 8% bandwidth with <1 dB variation.

Figure 2:
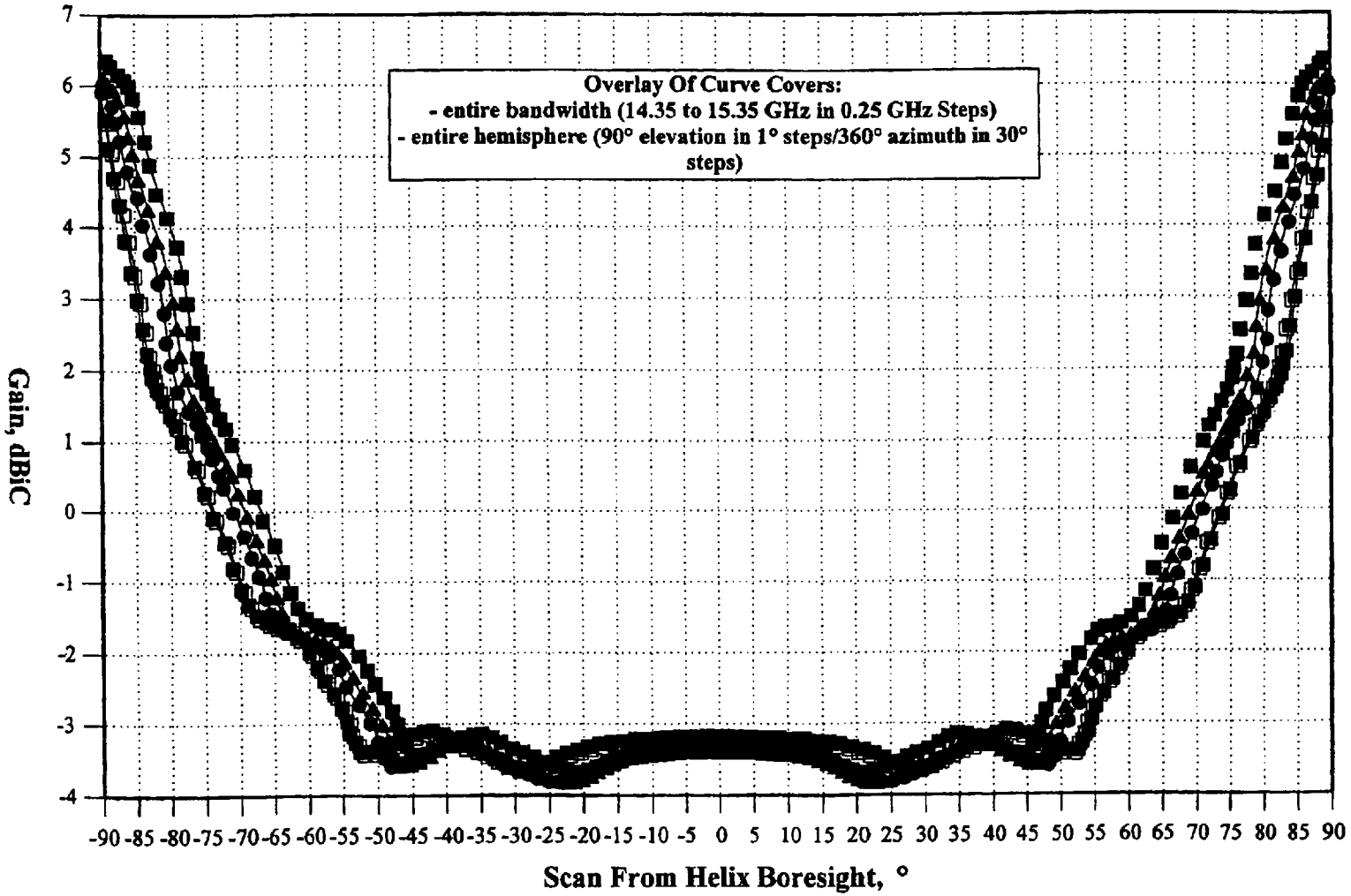
FIG. 2 is a gain vs. scan plot showing the performance of a quadrifilar helix antenna in FIG. 1 over a specified frequency range.

FIG. 2 is an overlay of curves showing the gain of an antenna using the foregoing optimized values for a frequency range of 14.35 GHz to 15.35 GHz in 0.25 GHz steps. Using this frequency range and the optimized values set forth above will result in antenna elements with a turn diameter of 0.152 inches, and an overall axial length of 3.48 inches.

The curves in FIG. 2 show the antenna response over an entire hemisphere (90° elevation in 1° steps and covering a 360° range of azimuth angles in 30° steps. The curves illustrate gain relative to scan from helix boresight that is along the axis "a" of the antenna. As shown in FIG. 2, the optimized design provides in excess of 6 dBiC of gain at an angle of 90° relative to boresight along axis "a". As used herein dBiC refers to circularly polarized gain or loss. The 90° angle is approximately equivalent to the direction of the horizon when the axis of the antenna is oriented vertically. A further advantage of the design is that the gain decreases by a factor of approximately 10 dB along boresight, which is roughly when the satellite or airborne vehicle is directly overhead. The invention also eliminates the need for one or more baluns as part of the feed circuitry as is normally required for conventional quadrifilar helix antenna designs. Notably, these results are achieved at least throughout the 6.7% bandwidth illustrated by the various curves.

Those skilled in the art will appreciate that one or more of the optimal values provided herein can be varied somewhat within the scope of the invention without departing substantially from the results achieved. For example, the number of turns, the diameter of the turns, and the pitch angle can all be varied from between about 18% and 40% from the nominal values provided while still providing results similar to those obtained using the nominal values.

What is claimed is:

1. A quadrifilar helix antenna, comprising:

a radiating member comprising four orthogonal conductive elements helically wound around a common axis, each said conductive element comprising between 3 to 7 turns about said common axis at a pitch of between 45 to 65 degrees, each said turn having a diameter of approximately 0.13 wavelengths to 0.27 wavelengths;

a feed coupler exciting each of said orthogonal conductive elements in phase quadrature at a feed point located at a first end of said antenna adjacent to a ground plane;

an opposing end of each of said conductive elements distal from said feed point forming an open circuit; and wherein said antenna has a peak gain on horizon when said common axis is oriented vertically.

2. The antenna according to claim 1 wherein said antenna has an axial length of about 2.3 wavelength; to 8.9 wavelengths.

3. The antenna according to claim 1 wherein said antenna has an axial length of about 4.2 wavelengths to 4.5 wavelengths.

4. The antenna according to claim 1 wherein said conductive element comprises approximately 5 turns.

5. The antenna according to claim 1 wherein said pitch is approximately 55 degrees.

6. The antenna according to claim 1 wherein each said turn has a diameter of approximately 0.18 wavelengths to 0.2 wavelengths.

7. The antenna according to claim 1 wherein said antenna has a gain of at least 5 dBiC on horizon when said common axis is oriented vertically.

8. The antenna according to claim 1 wherein said antenna has a 3 dB bandwidth of 5% to 8% of a center operating frequency.

9. The antenna according to claim 1 wherein said antenna has an input VSWR of between about 1.0 and 1.5 within an operating bandwidth of between 5% to 8% of a center operating frequency.

10. A quadrifilar helix antenna, comprising:

a radiating member comprising four orthogonal conductive elements helically wound around a common axis, each said conductive element comprising 3 to 7 turns about said common axis; and a feed coupler exciting each of said orthogonal conductive elements in phase quadrature at a feed point located at a first end of said antenna adjacent to a ground plane;

an opposing end of each of said conductive elements distal from said feed point forming an open circuit; and wherein said antenna has a peak gain on horizon when said common axis is oriented vertically.

11. The antenna according to claim 10 wherein said antenna has a peak gain of at least about 5 dBiC.

12. The antenna according to claim 10 wherein said conductive element comprises approximately 5 turns.

13. The antenna according to claim 10 wherein each said turn has a diameter of about 0.13 wavelengths to 0.27 wavelengths.

14. The antenna according to claim 10 wherein each said turn has a diameter of approximately 0.18 wavelengths to 0.2 wavelengths.

15. The antenna according to claim 10 wherein said conductive elements are helically wound around said common axis at a pitch of between 45 to 65 degrees.

16. The antenna according to claim 10 wherein said conductive elements are helically wound around said common axis at a pitch of approximately 55 degrees.

17. The antenna according to claim 10 wherein said antenna has an axial length of 2.3 wavelengths to 6.9 wavelengths.

18. The antenna according to claim 10 wherein an axial length of said antenna is approximately 4.2 wavelengths to 4.5 wavelengths.

19. The antenna according to claim 10 wherein said antenna has an input VSWR of between about 1.0 and 1.5 within an operating bandwidth of between 5% to 8% of a center operating frequency.

20. A quadrifilar helix antenna, comprising:

a radiating member comprising four orthogonal conductive elements helically wound around a common axis, each turn having a diameter of about 0.13 wavelengths to 0.27 wavelengths; and a feed coupler exciting each of said orthogonal conductive elements in phase quadrature at a feed point located at a first end of said antenna adjacent to a ground plane;

an opposing end of each of said conductive elements distal from said feed point forming an open circuit; and wherein said antenna has a peak gain on horizon when said common axis is oriented vertically.

21. The antenna according to claim 20 wherein said antenna has a peak gain of at least about 5 dBiC.

22. The antenna according to claim 20 wherein said conductive element comprises approximately 3 to 7 turns.

23. The antenna according to claim 20 wherein said conductive element comprises approximately 5 turns.

24. The antenna according to claim 20 wherein each said turn has a diameter of approximately 0.18 wavelengths to 0.2 wavelengths.

25. The antenna according to claim 20 wherein said conductive elements are helically wound around said common axis at a pitch of between 45 to 65 degrees.

26. The antenna according to claim 20 wherein said conductive elements are helically wound around said common axis at a pitch of approximately 55 degrees.

27. The antenna according to claim 20 wherein said antenna has an axial length of 2.3 wavelengths to 6.9 wavelengths.

28. The antenna according to claim 20 wherein an axial length of said antenna is approximately 4.2 wavelengths to 4.5 wavelengths.

29. The antenna according to claim 23 wherein said antenna has an input VSWR of between about 1.0 and 1.5 within an operating bandwidth of between 5% to 8% of a center operating frequency.

30. A quadrifilar helix antenna, comprising:

a radiating member comprising four orthogonal conductive elements helically wound around a common axis, each said conductive element comprising approximately 5 turns about said common axis at a pitch of approximately 55 degrees, each said turn having a diameter of approximately 0.18 wavelengths to 0.2 wavelengths;

a feed coupler exciting each of said orthogonal conductive elements in phase quadrature at a feed point located at a first end of said antenna adjacent to a ground plane;

an opposing end of each of said conductive elements distal from said feed point forming an open circuit; and wherein said antenna has a peak gain on horizon when said common axis is oriented vertically.

31. The antenna according to claim 30 wherein said peak gain is at least about 5 dBiC.

32. The antenna according to claim 30 wherein said peak gain is at least about 6.5 dBiC.

* * * * *

UNITED STATES PATENT AND TRADEMARK OFFICE

CERTIFICATE OF CORRECTION

PATENT NO. : 6,812,906 B2
DATED : November 2, 2004
INVENTOR(S) : Goldstein et al.

It is certified that error appears in the above-identified patent and that said Letters Patent is hereby corrected as shown below:

Title page,
Item [54], Title, delete "QUARDIFILAR" and replace with -- QUADRIFILAR --

Column 4,
Line 4, delete ";"
Line 4, delete "8.9" and replace with -- 6.9 --

Signed and Sealed this

Seventh Day of June, 2005

JON W. DUDAS
*Director of the United States Patent and Trademark Office*